US006037760A

United States Patent [19]

Borghi et al.

[11] Patent Number: 6,037,760

[45] Date of Patent: Mar. 14, 2000

[54] METHOD AND CIRCUIT FOR CONTROLLING THE CHARGE OF A BOOTSTRAP CAPACITOR IN A SWITCHING STEP-DOWN REGULATOR

[76] Inventors: Maria Rosa Borghi, Via Clerici, 159, I-20010 Marcallo Con Casone (Mi); Antonio Magazzu' , Via Messina 2—Pal. 6, I-95125 Catania, both of Italy

[21] Appl. No.: 08/895,697

[22] Filed: Jul. 17, 1997

[30] Foreign Application Priority Data

Jul. 31, 1996 [EP] European Pat. Off. ..... 96830431

[51] Int. Cl.[7] ..... G05F 1/44

[52] U.S. Cl. ..... 323/282; 323/288; 323/286

[58] Field of Search ..... 323/282, 286, 323/288; 363/16, 17, 56, 80, 89

[56] References Cited

U.S. PATENT DOCUMENTS

| | | | |
|---|---|---|---|
| 4,521,725 | 6/1985 | Phaneuf | 323/282 |
| 4,553,082 | 11/1985 | Nesler | 323/288 |
| 4,587,441 | 5/1986 | Torelli et al. | 307/269 |
| 5,365,118 | 11/1994 | Wilcox | 327/109 |
| 5,408,150 | 4/1995 | Wilcox | 327/108 |
| 5,627,460 | 5/1997 | Bazinet et al. | 323/282 |

FOREIGN PATENT DOCUMENTS

| | | | |
|---|---|---|---|
| A-0 367 006 | 5/1990 | European Pat. Off. | H03K 17/06 |

*Primary Examiner*—Peter S. Wong
*Assistant Examiner*—Rajnikant B. Patel
*Attorney, Agent, or Firm*—Wolf, Greenfield & Sacks, P.C.

[57] ABSTRACT

A method of controlling the charging of a bootstrap capacitance incorporated into a switching regulator of a power transistor includes the steps of comparing, at each switching cycle, the voltage value at the bootstrap capacitance and a predetermined threshold voltage, to change the mode of operation of the regulator following said comparison. More particularly, the control on the transistor is taken off the regulator when the voltage at the bootstrap capacitance is lower than the threshold voltage, while the transistor is forced into the "on" state through a full cycle. In this way, the minimum current to operate the regulator can be minimised.

20 Claims, 6 Drawing Sheets

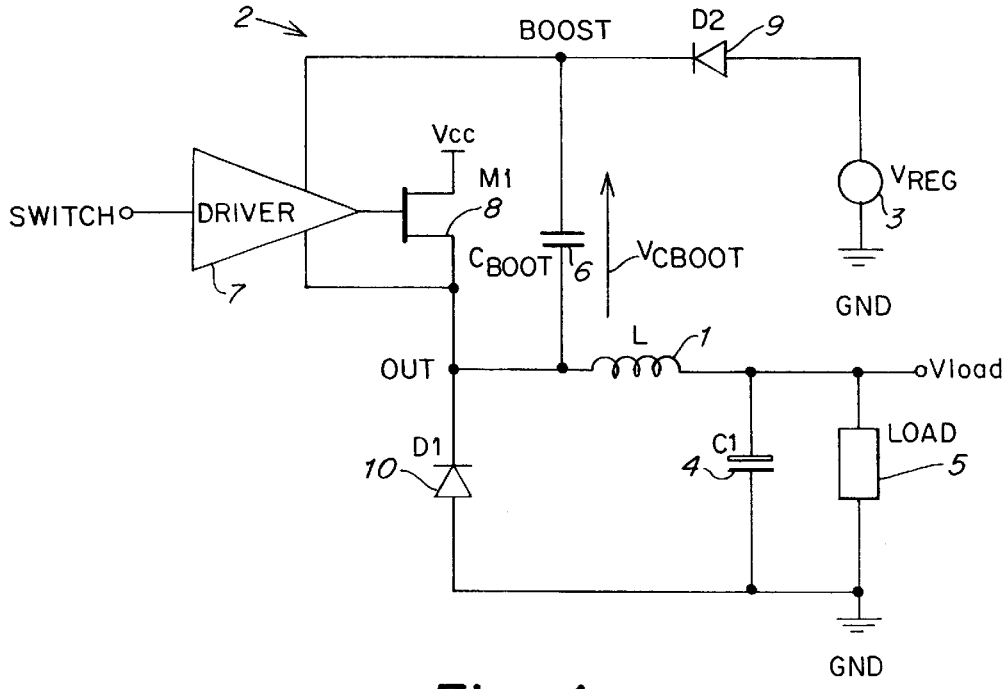
Fig. 1
(PRIOR ART)
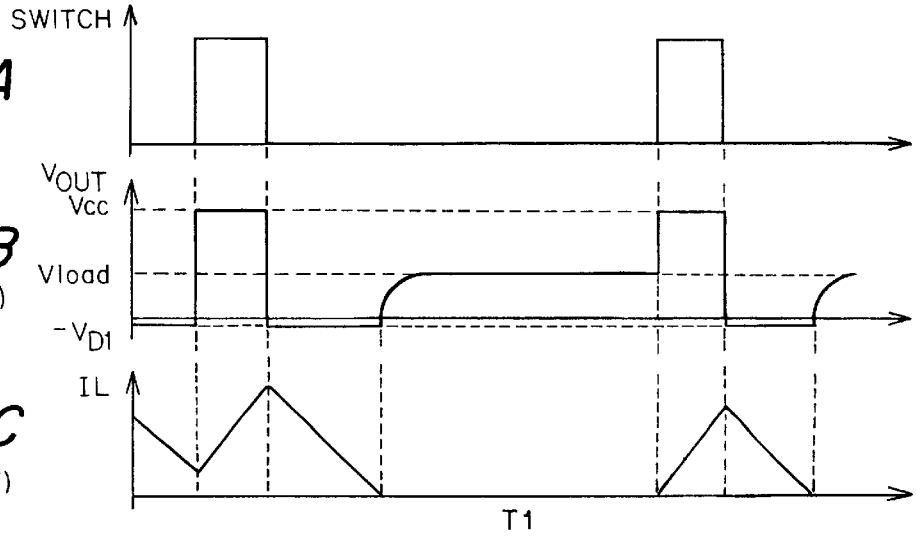
Fig. 2A
(PRIOR ART)
Fig. 2B
(PRIOR ART)
Fig. 2C
(PRIOR ART)

SWITCH

VOUT

IL

VCBOOT

VREG-VD2-Vload
I(VREG)
IMAX

Idriver

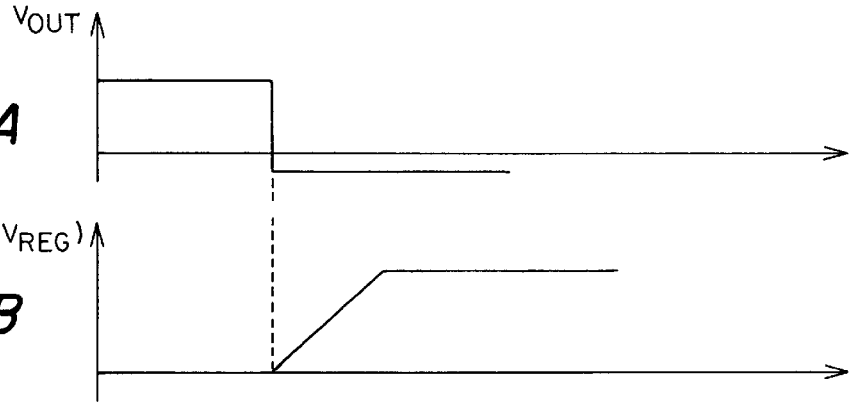
Fig. 4A
(PRIOR ART)
Fig. 4B
(PRIOR ART)
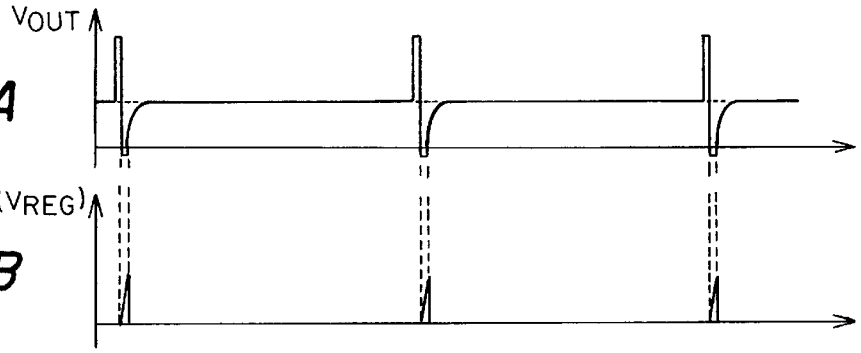
Fig. 5A
(PRIOR ART)
Fig. 5B
(PRIOR ART)

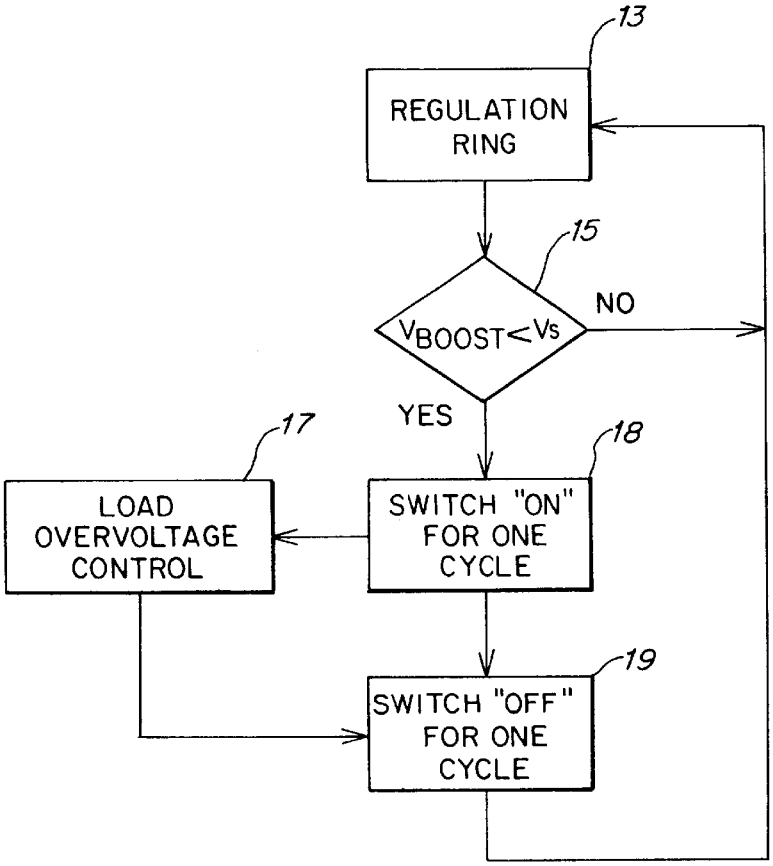
Fig. 7
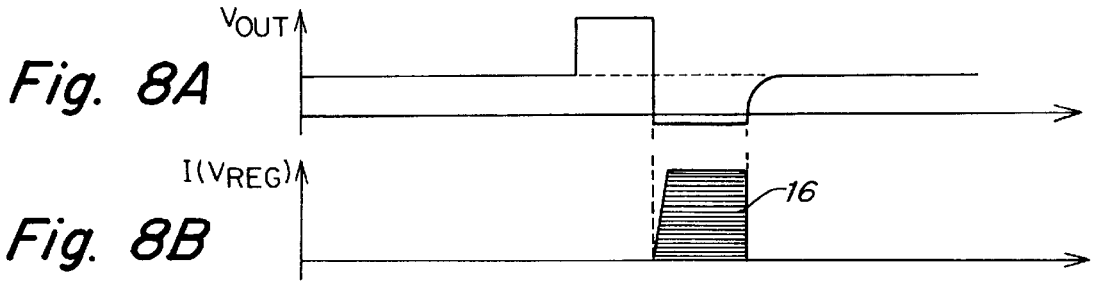

METHOD AND CIRCUIT FOR CONTROLLING THE CHARGE OF A BOOTSTRAP CAPACITOR IN A SWITCHING STEP-DOWN REGULATOR

BACKGROUND OF THE INVENTION

1. Field of the Invention

This invention relates in general to switching regulators and more specifically to a method of controlling the charging of a bootstrap capacitance which is incorporated into a switching regulator of a power regulator connected to an electric load.

2. Discussion of the Related Art

As is well known, many applications in the electric industry require that the value of a current through an electric load be regulated.

The most commonly adopted solution for regulating a lower output voltage than the input voltage is to use a switching regulator of the step-down type. In this case, the current through the electric load is regulated by means of a power transistor which is controlled from a driver circuit.

The state of the art favors the use of MOS transistors as the power switches, in preference to bipolar transistors. The provision of a MOS transistor affords improved efficiency for the regulator as a whole; it also involves, however, added circuit complexity in that a second power supply, higher than that to be applied to the drain terminal, must be provided for charging the gate terminal of the MOS transistor.

Several prior solutions are available for producing the aforementioned second power supply, of which the most commonly adopted one provides for the use of a bootstrap capacitance which can be re-charged during the conduction phase of a recirculation diode. Other, and more complex, solutions, such as the provision of a step-up circuit for producing the desired power supply, involve an increased number of outward connections for the integrated circuit. It has also been proposed to use an internal charge pump, but this solution cannot provide the amount of charge required for fast changeovers of the MOS switch.

In the respect of the first-mentioned solution, the use of a bootstrap capacitance restricts the operational conditions of the switching regulator. In fact, where the voltage value to be regulated exceeds the difference between the voltage value to which the bootstrap capacitance is charged and the turn-on threshold of the MOS switch, the regulating system can only operate properly if the load output current is larger than a minimum current $I_{MIN}$.

To illustrate this concept, a review of the operation of a switching regulator 2 of the step-down type may be helpful. The bootstrap capacitance is powered from a voltage generator $V_{REG}$ 3 having a diode D2 9 in a series therewith, as shown in the accompanying FIG. 1.

A MOS transistor M1 8 operates as a switch to regulate the current being supplied to an electric load LOAD 5. For the purpose, the switch M1 has a first conduction terminal connected to a supply voltage reference Vcc, and a second conduction terminal OUT connected to the load LOAD through an inductance L 1. A diode D1 10 is connected between the terminal OUT and one end of the LOAD 5 taken to a ground GND. A capacitor C1 4 is provided in parallel with the LOAD 5. The gate terminal of the switch M1 is connected to the output of a driver circuit DRIVER 7.

With the switch M1 in the off state, the current to the inductance L 1 flows through the diode D1 10, presently conducting, so that the voltage at the node OUT will turn negative and be equal to $-V_{D1}$. Under this condition, the voltage generator $V_{REG}$ is able to deliver a current for charging the bootstrap capacitance $C_{BOOT}$ 6. The maximum voltage $C_{BOOT}$ 6 at that capacitance is given by:

$$C_{BOOTMAX}=V_{REG}-V_{D2}-(-V_{D1})\approx V_{REG};$$

With D1 conducting, $V_{REG}$ will deliver a current until $V_{cboot}$ becomes less than $C_{BOOTMAX}$, In operation at a small load current, there is a time period T1 when the current IL at the inductance L becomes zero, as shown in FIG. 2C. In this case, at the end of the discharge transient, the voltage $V_{OUT}$ at the node OUT becomes equal to Vload, as shown in FIG. 2B.

Referring now to FIGS. 3A–3E, it is shown that the bootstrap capacitance can only be charged during the time when the recirculation diode D1 is conducting, as shown in FIG. 3D. If the average current demanded by the load is a very small one, the pulses SWITCH for turning on the switch M1 are quite narrow and have a very large period, as shown in FIG. 3A, because a small current will suffice to regulate the output voltage Vload. At the end of the turn-on pulse, following a short time period of conduction of the diode D1 when the bootstrap capacitance $C_{BOOT}$ is being charged by the generator $V_{REG}$, the inductance current IL drops to zero, and the voltage $V_{OUT}$ at the node OUT becomes equal to Vload. Under this condition, the static consumption driver of the Idriver stage results in the bootstrap capacitance being gradually discharged. This discharge continues until the voltage $V_{CBOOT}$ across the capacitance equals the difference between $V_{REG}-V_{D2}$ and Vload, as shown in FIG. 3D.

Under these conditions, in order for the switch M1 to change over at the next turn-on pulse, the voltage at the bootstrap capacitance should be higher than the turn-on threshold $V_{TH}$ of the NMOS transistor M1, i.e.:

$$V_{REG}-V_{D2}-V_{LOAD}\geqq V_{TH};$$

Given that $V_{MAX}=V_{REG}-V_{D2}-V_{TH}$; if the voltage to be regulated is higher than $V_{MAX}$, then the switching regulator will only operate properly at larger currents than a minimum value $I_{MIN}$ which is proportional to the consumption of the driver circuit. With currents below a value $I_{MIN}$, the output voltage Vload will equal $V_{MAX}$.

In actual constructions of step-down switching regulators, the critical current for proper operation of the circuit is much larger than the theoretical value of $I_{MIN}$, because the considerations made above takes no account of the less-than-ideal nature of the voltage generator $V_{REG}$. In fact, no real generator would be able to deliver its maximum current at once, especially when constructed for a small drop, as is usual in most instances. By way of example, FIGS. 4A and 4B shows the current $I(V_{REG})$ to be delivered by the generator $V_{REG}$ upon the diode D1 being turned on.

In a condition of minimum load, the switch M1 would be held "on" for a very short time, and the amount of charge fed to the bootstrap capacitance from $V_{REG}$ would be less than optimum, as shown in FIGS. 5A and 5B, where the triangular areas in FIG. 5B, represent the amounts of charge.

The underlying technical problem of this invention is to provide a method for optimising the charging of a bootstrap capacitance during operation of a switching circuit of the step-down type, which method can obviate the drawbacks with which prior switching regulators have been beset.

SUMMARY OF THE INVENTION

The solution idea on which this invention stands is that of so modifying the drive signal being applied to the transistor switch as to have the latter turned on at less frequent intervals, but held in the "on" state for a longer time. In this way, the charge of the bootstrap capacitance can be optimised, enabling the generator $V_{REG}$ to deliver its maximum current and, consequently, lowering the minimum value of the load current $I_{MIN}$. In addition, the overall efficiency of the system can be improved because the gate terminal of the switch is charged less frequently.

Based on this solution, according to one aspect of the invention, a method of controlling the charging of a bootstrap capacitance of a switching regulator of a power regulator, the power regulator including a switch that is disposed between a driver and the switching regulator includes the steps of: comparing, at each switching cycle of the power regulator, a voltage of the bootstrap capacitance and a predetermined threshold voltage and disabling operation of the switching regulator when the voltage of the bootstrap capacitance is lower than the threshold voltage.

According to another aspect of the invention, a circuit for controlling the charging of a bootstrap capacitance incorporated into a switching regulator, the switching regulator further comprising a switch disposed between a driver and the bootstrap capacitance, the circuit includes a comparator, coupled to the bootstrap capacitance and to a threshold voltage, wherein the switch couples the driver to the bootstrap capacitance in response to an indication by the comparator that a voltage across the bootstrap capacitance is less than the threshold voltage.

The features and advantages of the method and circuit according to the invention will be apparent from the following description of embodiments thereof, given by way of example and not of limitation with reference to the accompanying drawings.

BRIEF DESCRIPTION OF THE DRAWINGS

FIG. 1 is a diagrammatic view of a switching regulator according to the prior art;

FIGS. 2A, 2B and 2C show respective graphs, plotted on the same time base, of voltage and current signals which are present in the regulator of FIG. 1 during operation at a small load current;

FIGS. 4A and 4B show respective graphs, on the same time base, of more voltage and current signals appearing in the regulator of FIG. 1;

FIGS. 5A and 5B show respective graphs, on the same time base, of the voltage and current signals in FIG. 4 under a different condition of operation of the regulator of FIG. 1;

FIG. 7 is a flow chart illustrating the regulating method of this invention;

FIGS. 8A and 8B show respective graphs, plotted on the same time base, of voltage and current signals which are present in a regulator controlled by the method of this invention.

DETAILED DESCRIPTION

Figures 3A, 3B, 3C, 3D, 3E:
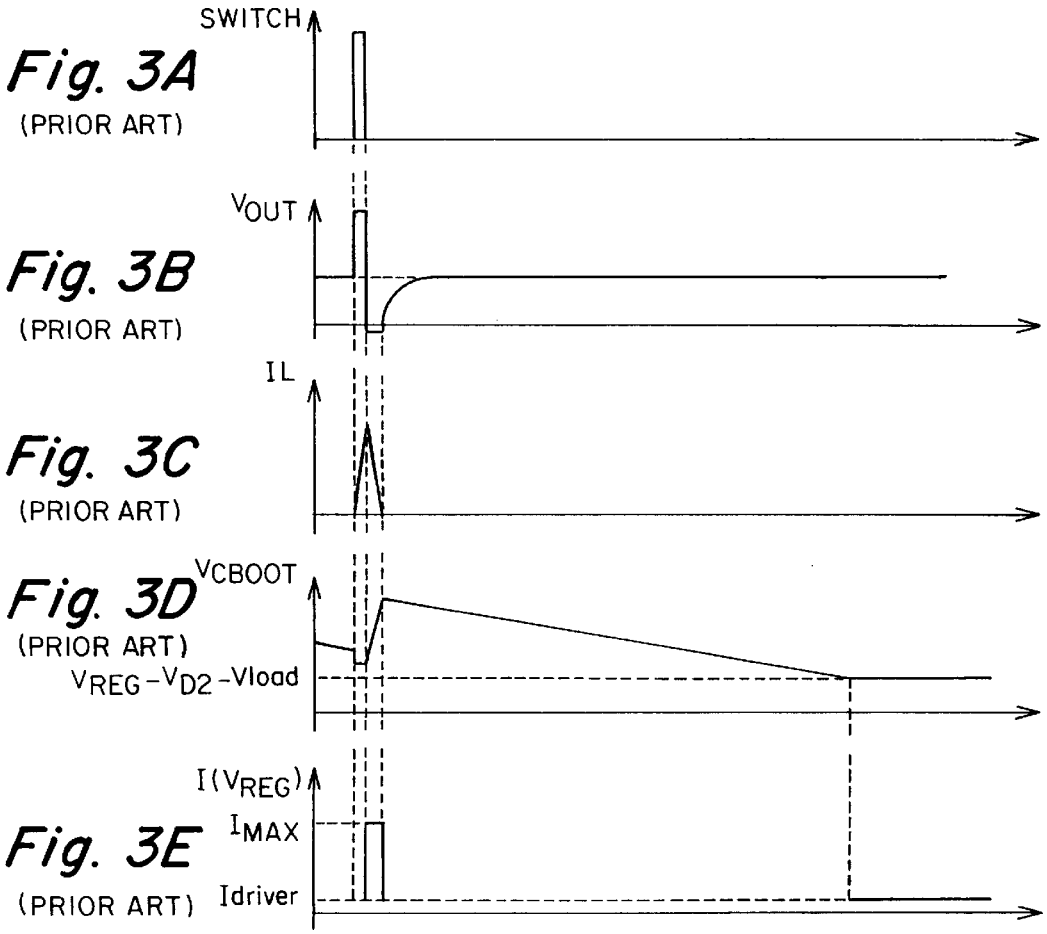
Fig. 3A (PRIOR ART)
Fig. 3B (PRIOR ART)
Fig. 3C (PRIOR ART)
Fig. 3D (PRIOR ART)
Fig. 3E (PRIOR ART)
FIGS. 3A, 3B, 3C, 3D and 3E show respective graphs, on the same time base, of voltage and current signals which are present in the regulator of FIG. 1 in another condition of its operation.
Figure 6:
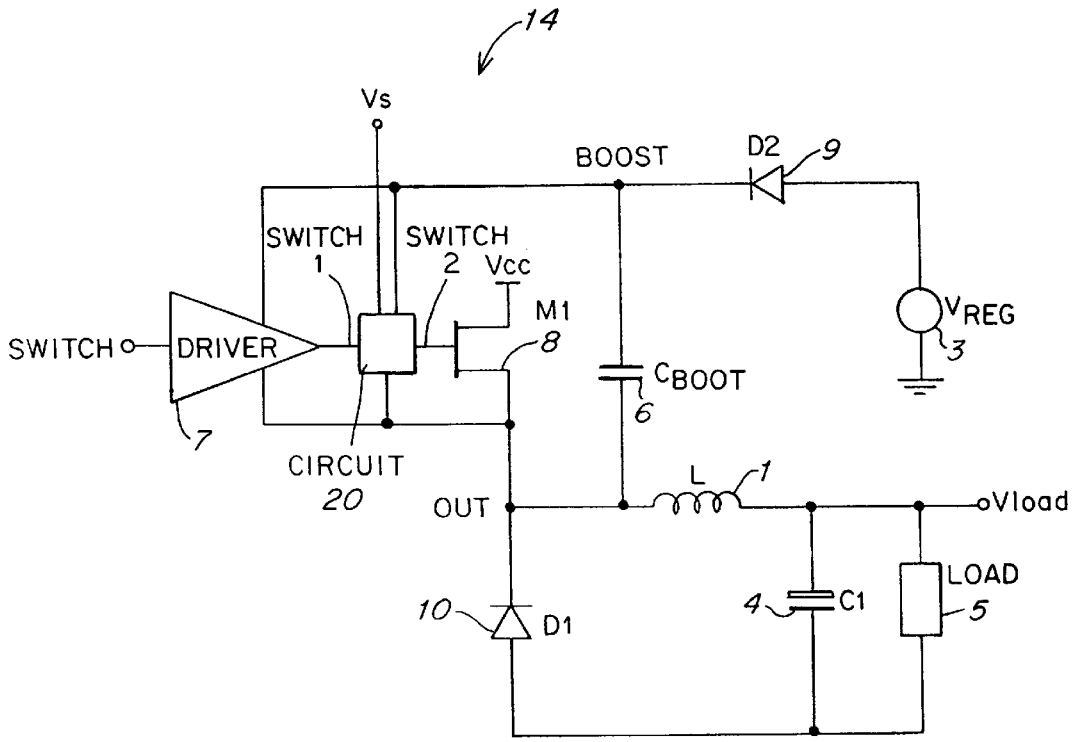
FIG. 6 is a block diagram of one embodiment of a switching regulator employing the present invention.

Referring to the drawing figures, in particular to the example shown in FIG. 6, one emobidment of a switching regulator 14 incorporating the switching methods of the present invention as shown.

The switching regulator 14 includes elements similar to those of FIG. 2, but additionally includes a control circuit 20 coupled between voltage OUT and BOOST, and further coupled to a switching voltage Vs that sets a threshold for the compare operation.

The control circuit 20 compares, at each switching cycle, the voltage at this bootstrap capacitance, which is measured by subtracting $V_{OUT}$ from $V_{BOOST}$, with a predetermined threshold voltage Vs. When the voltage at one input of the comparator is higher than the threshold Vs, the regulator is allowed to operate as normal; otherwise, control of the transistor switch is taken off the regulator and the switch is forced into the "on" state for a full cycle.

In essence, the switching regulator is operated in two distinct modes. When the voltage at the bootstrap capacitance is below the threshold Vs of the comparator, the regulating loop is no longer in control, and the switch will be forced into the "on" state for a full cycle. Throughout the following cycle, the switch will be held in the "off" state to allow for the bootstrap capacitance charging.

Referring now to FIG. 7, a flowchart illustrating the operation of the switching reguator of the present invention is shown. At step 13 the switching regulator 14 operates as a regulating loop to switch over the transistor M1 of FIG. 1. At step 15 the voltage $V_{BOOST}$ at the bootstrap capacitance is compared against voltage Vs to determine whether this voltage is below the threshold voltage Vs of a comparator 20, whose construction will be described hereinafter. If $V_{BOOST} \geqq Vs$, the process returns to step 13 where control is at once restored to the regulating loop.

If, at step 13, it is determined that $V_{BOOST}$ is less than Vs, at step 18 the switch M1 is forced "on" for the duration of a full cycle, thereby disabling the regulating loop.

When the regulating loop is disabled, at step 17 the output voltage $V_{LOAD}$ of the regulator 14 must be further checked. This additional check is carried out by means of a comparator, (not shown) which will force the switch into the "off" state at step 19 upon a predetermined overvoltage threshold being overtaken.

By so controlling the operation of the regulator 14, the minimum operating current $I_{MIN}$ can be minimised. In fact, this current $I_{MIN}$ is the same as the current that would be made available by an ideal voltage generator $V_{REG}$, in that the amount of the charge supplied by the generator $V_{REG}$ is of the type indicated in FIG. 8B by an area 16.

Figure 9:
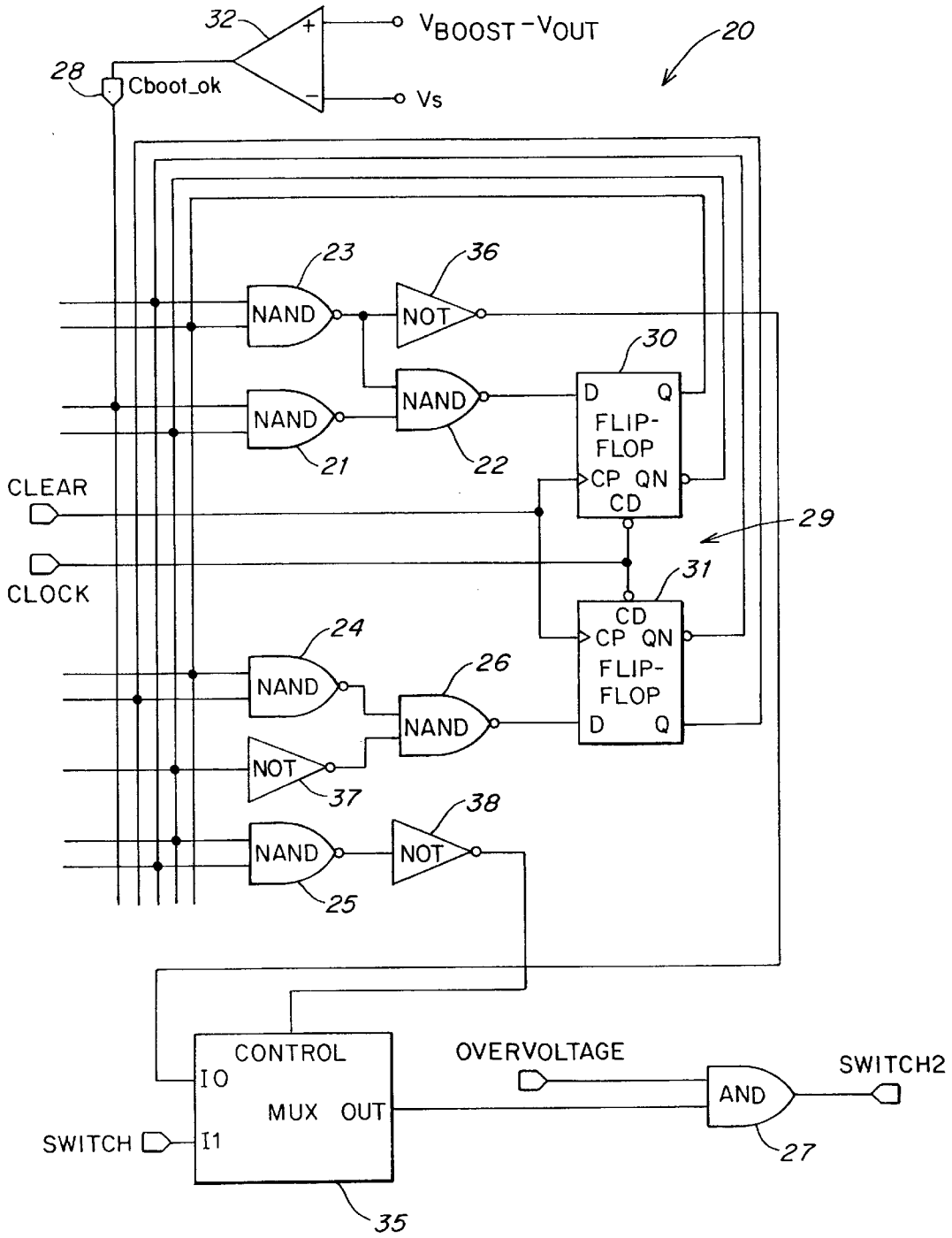
FIG. 9 is a diagrammatic view of a control circuit for implementing the method of this invention.

The construction of the control circuit 20 for implementing the inventive method will presently be described with reference in particular to the example shown in FIG. 9. The circuit 20 comprises a comparator 32 and a network 29 of logic gates, and certain storage elements, such as flip-flops of the D type. The comparator 32 has an inverting input which is held at a voltage threshold Vs, and a non-inverting input having a voltage equal to $V_{BOOST}-V_{OUT}$ is presented. The comparator 32 has an output 28 on which a signal Cboot_ok is produced which corresponds to a voltage value detected on the bootstrap capacitance. This signal will be active when its logic value is low.

The output 28 is coincident with a first input of a first logic gate 21 of the NAND type, having two inputs and an output connected to one input of a second two-input logic gate 22 of the NAND type.

The output of this second gate 22 is connected to an input D of a storage element 30 having a natural output Q which is feedback connected to one input of a third logic gate 23 of the NAND type. The negated output QN of the storage element 30 is connected to the second input of the first logic gate 21.

The output of the third gate 23 is connected to the second input of the second gate 22, as well as to an input I0 of a multiplexer 35 via a first inverter 26.

Fourth and fifth logic gates, both of the two-input NAND type and denoted by 24 and 25, respectively, receive on respective inputs, the signal from the natural output Q of the element 30 and the signal from the negated output QN of the element 30. The output of the fourth gate 24 is connected to one input of a sixth two-input NAND gate 26 whose output is connected to an input D of a second storage element 31.

The second storage element 31 also has a natural output Q and a negated output QN. The negated output QN is connected to the second input of the third logic gate 23 and the second input of the fifth logic gate 25. The natural output Q of the second element 31 is connected, on the other hand, to the second input of the fourth logic gate 24.

Finally, it should be noted that the negated output of the first storage element 30 is connected, via a second inverter 37, to the second input of the sixth logic gate 26.

The multiplexer 35 has a control input connected to the output of the fifth gate 25 via a third inverter 38.

Another input of the multiplexer 35 receives directly a control signal SWITCH from the regulator 14.

The multiplexer 35 has an output OUT connected to one input of a seventh logic gate 27 of the two-input AND type. The other input of the gate 27 receives an overvoltage control signal OVERVOLTAGE from an overvoltage check circuit (not shown).

The output of the logic gate 27 corresponds to the control output of the control circuit 20. A signal SWITCH2 is produced on this output and applied to the gate terminal of the power transistor M1 whenever the transistor M1 is to be forced into the "on" state following a comparison of the bootstrap capacitance voltage with the threshold voltage Vs.

For completeness of description, the presence should be considered of an applied signal CLEAR, and of respective reset inputs CP on both storage elements 30 and 31. CLEAR is a supply control signal required for proper start-up of the switch and acts to clear the state of both storage elements 30 and 31.

Furthermore, a signal CLOCK is applied to respective inputs CD of the storage elements 30 and 31 to regulate their operational clocking. CLOCK is a signal which sets the operational frequency of the step-down switching regulator 14. With this signal CLOCK at a high level, the switch M1 is sure to be in the "off" state.

OVERVOLTAGE is the signal for controlling overvoltages at the regulator output. The signal SWITCH2 controls the switch M1 to the "on" state. When the capacitance voltage is correct, this signal is coincident with the signal SWITCH as set by the regulating loop of the regulator 14; otherwise, SWITCH2 will force the switch M1 into the "on" state through one cycle, and the "off" state through the next, when no overvoltage is presented at the load.

Thus, a method and appartaus for charging a bootstrap capacitance has been described.

Having descrived at least one illustrative embodiment of the invention, various alterations, modifications and improvements will readily occur to those skilled in the art. Such alterations, modifications, and improvements are intended to be within the spirit and scope of the invention. Accordingly, the foregoing description is by way of example only and is not intended as limiting. The invention is limited only as defined in the following claims and equivalents thereto.

What is claimed is:

1. A method of controlling the charging of a bootstrap capacitance of a switching regulator of a power regulator, the power regulator including a switch that is disposed between a driver and the switching regulator, the method comprising the steps of:

comparing, at each switching cycle of the power regulator, a voltage of the bootstrap capacitance and a predetermined threshold voltage; and disabling operation of the switching regulator when the voltage of the bootstrap capacitance is lower than the threshold voltage.

2. The method according to claim 1, wherein the step of disabling further comprises the step of controlling the switch to couple the driver to the switching regulator.

3. The method according to claim 2 wherein the switch is a transistor.

4. The method according to claim 2 wherein the switch couples the driver to the switching regulator for a full switching cycle when the voltage of the bootstrap capacitance is lower than the threshold voltage.

5. The method according to claim 1 wherein the step of disabling further includes the step of checking an output voltage of the switching regulator when the switching regulator is disabled to determine whether the output voltage is in an overvoltage state.

6. The method according to claim 1 wherein the switching regulator operates to charge the bootstrap capacitance using a voltage generator when the bootstrap capacitance is greater than the threshold voltage.

7. A method of controlling the charging of a bootstrap capacitance of a switching regulator, the switching regulator comprising a switch that is disposed between a driver and the switching regulator, the method comprising the steps of:

comparing, at each switching cycle of the switching regulator, a voltage of the bootstrap capacitance and a predetermined threshold voltage;

selecting one of a plurality of modes of operation of the switching regulator in response to a relative relationship between the voltage of the bootstrap capacitance and the predetermined threshold voltage; and disabling operation of the switching regulator responsive to the selected one of the plurality of modes of operation.

8. The method according to claim 7, wherein one of the plurality of modes of operation includes a first mode of operation wherein the bootstrap capacitance is charged by a voltage generator of the switching regulator and a second one of the plurality of modes of operation includes a second mode of operation wherein the bootstrap capacitance is charged by a driver coupled to the switching regulator by a switch.

9. The method according to claim 8, wherein the second mode of operation is a charging mode.

10. The method according to claim 9, wherein the charging mode is selected in response to the voltage of the bootstrap capacitance being less than the threshold voltage.

11. The method according to claim 10, wherein the driver is coupled to the switching regulator for a full cycle during charging mode.

12. A circuit for controlling the charging of a bootstrap capacitance incorporated into a switching regulator, the switching regulator further comprising a switch disposed between a driver and a bootstrap capacitance, the circuit comprising:

a comparator, coupled to the bootstrap capacitance and to a threshold voltage to provide an indication that a voltage across the bootstrap capacitance is less than the threshold voltage;

a selector to select between a first switching signal provided by the driver and a second switching signal provided by the circuit responsive to the indication from the comparator.

13. The circuit according to claim 12, wherein the switch is a transistor.

14. The circuit according to claim 12, further comprising:

a plurality of logic gates, at least one of the logic gates coupled to an output of the comparator;

wherein the selector includes a pair of inputs, one of the pair of inputs being coupled to the plurality of logic gates, a second one of the plurality of inputs being coupled to a switching regulator, the selector controlled by outputs from the plurality of logic gates, the selector providing an output signal for controlling the switch to couple the driver to the bootstrap capacitance.

15. The circuit according to claim 14, wherein the output signal is further controlled by an overvoltage signal representing that a load coupled to the switching regulator is in an overvoltage state.

16. A power regulating system for providing a voltage to a load during a plurality of switching cycles, the switching regulator comprising:

a driver to provide a first switching signal;

a switching regulator, coupled to the driver by a switch, the switching regulator further comprising:

a bootstrap capacitor disposed between a voltage generator and a load;

a circuit, coupled to control the switch, for comparing a voltage across the bootstrap capacitor against a threshold voltage to determine a mode of operation of the power regulator, the circuit including:

a comparator, coupled to the bootstrap capacitance and to a threshold voltage to provide an indication that a voltage across the bootstrap capacitance is less than the threshold voltage, and a selector to select between the first switching signal provided by the driver and a second switching signal provided by the circuit responsive to the indication from the comparator.

17. The power regulator according to claim 16, wherein the circuit provides a signal for controlling the switch, wherein the signal is asserted only for those switching cycles wherein the voltage across the bootstrap capacitor is less than the threshold voltage.

18. A power regulating system for providing a voltage to a load during a plurality of switching cycles, the switching regulator comprising:

a driver;

a switching regulator, coupled to the driver by a switch, the switching regulator further comprising:

a bootstrap capacitor disposed between a voltage generator and a load;

means for controlling the switch such that the switch is engaged to couple the driver to the switching regulator only for those switching cycles wherein the voltage across the bootstrap capacitor is less than a threshold voltage.

19. The power regulator according to claim 18 further comprises:

means for comparing the voltage across the bootstrap capacitor to the threshold voltage;

means, responsive to the means for comparing, for coupling the driver to the switching regulator for a full switching cycle.

20. The power regulator according to claim 18, further comprising means for disabling the switch in response to an overvoltage of the load.

* * * * *